US009322105B2

(12) United States Patent
Fassbender et al.

(10) Patent No.: US 9,322,105 B2
(45) Date of Patent: Apr. 26, 2016

(54) RECOVERING LEAD FROM A LEAD MATERIAL INCLUDING LEAD SULFIDE

(71) Applicants: BASF SE, Ludwigshafen (DE); The University of British Columbia, Vancouver (CA)

(72) Inventors: Stefan Fassbender, Speyer (DE); David Dreisinger, Delta (CA); Zhenghui Wu, Vancouver (CA)

(73) Assignee: The University of British Columbia, Vancouver (CA)

( * ) Notice: Subject to any disclaimer, the term of this patent is extended or adjusted under 35 U.S.C. 154(b) by 85 days.

(21) Appl. No.: 14/076,662

(22) Filed: Nov. 11, 2013

(65) Prior Publication Data

US 2014/0131220 A1 May 15, 2014

Related U.S. Application Data

(60) Provisional application No. 61/725,835, filed on Nov. 13, 2012.

(51) Int. Cl.

| | |
|---|---|
| ***C25C 1/18*** | (2006.01) |
| ***C22B 13/00*** | (2006.01) |
| ***C22B 3/16*** | (2006.01) |
| ***C22B 3/00*** | (2006.01) |

(52) U.S. Cl.

CPC . *C25C 1/18* (2013.01); *C22B 3/165* (2013.01); *C22B 13/04* (2013.01)

(58) Field of Classification Search

None

See application file for complete search history.

(56) References Cited

U.S. PATENT DOCUMENTS

| | | | | | |
|---|---|---|---|---|---|
| 1,752,356 | A | * | 4/1930 | Smith | 205/599 |
| 2,525,942 | A | * | 10/1950 | Proell | 205/263 |
| 3,929,597 | A | * | 12/1975 | Cottam et al. | 75/733 |
| 4,096,045 | A | * | 6/1978 | Ahonen et al. | 205/600 |
| 4,181,588 | A | * | 1/1980 | Wong et al. | 205/600 |
| 4,272,341 | A | * | 6/1981 | Lamb | 205/603 |
| 4,944,851 | A | * | 7/1990 | Cordani et al. | 205/575 |
| 5,039,337 | A | * | 8/1991 | Olper et al. | 75/725 |
| 5,262,020 | A | * | 11/1993 | Masante et al. | 205/599 |
| 5,494,649 | A | * | 2/1996 | Fristad et al. | 423/27 |
| 5,520,794 | A | * | 5/1996 | Gernon | 205/598 |
| 5,612,224 | A | * | 3/1997 | O'Brien | 436/73 |
| 5,762,683 | A | * | 6/1998 | Jackson et al. | 75/743 |

(Continued)

FOREIGN PATENT DOCUMENTS

| | | |
|---|---|---|
| JP | 2012072480 | 4/2012 |
| WO | WO2007099119 | 9/2007 |

OTHER PUBLICATIONS

Lee et al, Pressure Leaching of Galena Concentrates to Recover Lead Metal and Elemental Sulfur, Bureau of Mines Report of Investigations RI/9314, 1990 (no month), pp. 1-7.*

Gernon et al, Environmental benefits of methanesulfonic acid: Comparative properties and advantages, Green Chemistry, May 1999 vol. 1, Issue 3, pp. 127-140.*

(Continued)

*Primary Examiner* — Harry D Wilkins, III

(74) *Attorney, Agent, or Firm* — Dierker & Kavanaugh, P.C.

(57) ABSTRACT

In an example of a method for recovering lead from a lead material including lead sulfide, methane sulfonic acid is selected as a leaching acid for the lead material. The lead material is exposed to a solution including the methane sulfonic acid and i) ferric methane sulfonate or ii) oxygen, which leaches lead from the lead sulfide in the lead material, and generates a liquid leachate including a lead-methane sulfonate salt. The liquid leachate is purified, and lead is recovered from the purified liquid leachate using electrolysis.

18 Claims, 2 Drawing Sheets

(56) References Cited

U.S. PATENT DOCUMENTS

| | | | | |
|---|---|---|---|---|
| 5,935,409 | A * | 8/1999 | King et al. | 205/560 |
| 6,117,209 | A * | 9/2000 | Adanuvor | 75/739 |
| 6,428,676 | B1 * | 8/2002 | Onuoha | 205/478 |
| 7,368,043 | B2 | 5/2008 | Mohanta et al. | |
| 2009/0078087 | A1 * | 3/2009 | Heidenfelder et al. | 75/743 |
| 2015/0050199 | A1 * | 2/2015 | Korzenski et al. | 423/98 |

OTHER PUBLICATIONS

Wu, Zheng-hui, Fundamental Study on Extracting Lead from Cerussite Concentrate in Methane Sulfonic Acid Based Solution, Thesis submission to the University of British Columbia, Dec. 2012.*

International Search Report for PCT/IB2013/002535 dated Feb. 18, 2014 (7 pages).

* cited by examiner

RECOVERING LEAD FROM A LEAD MATERIAL INCLUDING LEAD SULFIDE

CROSS-REFERENCE TO RELATED APPLICATIONS

This application claims the benefit of U.S. Provisional Application Ser. No. 61/725,835, filed Nov. 13, 2012, which is incorporated by reference herein.

BACKGROUND

Lead is used in a variety of applications, including, for example, building construction, energy storage batteries (e.g., lead-acid batteries), weaponry (e.g., bullets, shots, etc.), and alloy materials (e.g., solders, pewters, fusible alloys, etc.). With such widespread application, annual lead production has expanded to greater than four million tons of refined metal. Lead may be recovered from natural ores (e.g., in a variety of mineral forms) or from recycling processes. Some lead recovery processes involve ore mining of sulfide ores, froth flotation (which produces a high grade lead concentrate), smelting of the lead concentrate (which produces crude lead metal), and refining of the crude lead metal. Lead recovery processes involving smelting often use high temperatures, which may generate volatile products that are difficult to control and/or contain.

BRIEF DESCRIPTION OF THE DRAWINGS

Features and advantages of examples of the present disclosure will become apparent by reference to the following detailed description and drawings, in which like reference numerals correspond to similar, though perhaps not identical, components. For the sake of brevity, reference numerals or features having a previously described function may or may not be described in connection with other drawings in which they appear.

DETAILED DESCRIPTION

The present disclosure relates generally to recovering lead from a lead material including lead sulfide. Examples of the method disclosed herein utilize methane sulfonic acid (MSA) for recovering lead from materials that include lead sulfide, such as galena (i.e., PbS). It has been found that the use of methane sulfonic acid in the method(s) disclosed herein enables lead recovery from lead sulfide-containing materials while advantageously avoiding high temperature smelting and the use of other acids, which may be unstable or may introduce other undesirable issues with lead recovery. For example, it has been found that the use of fluoboric (i.e., fluoroboric) acid and fluosilicic (i.e., fluorosilicic or hexafluorosilicic) acid results in the formation of free fluoride species, which can undesirably precipitate lead as lead-fluoride or lead oxy-fluoride.

Figure 1:
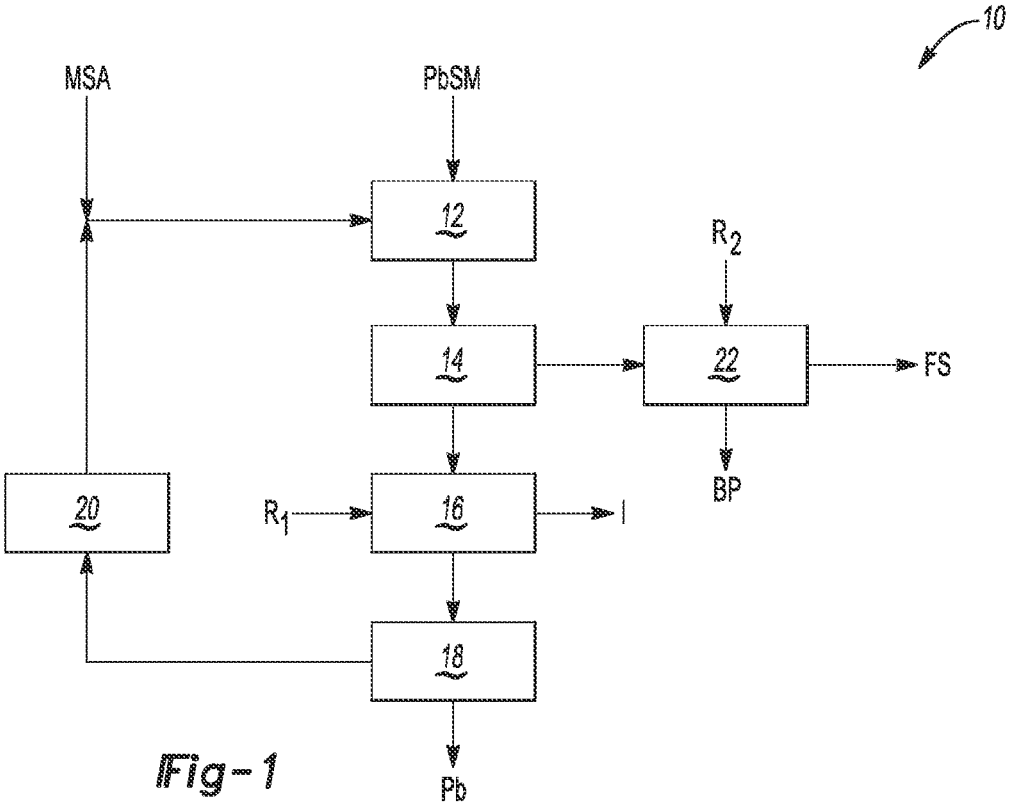
FIG. 1 is a schematic flow diagram depicting an example of a method for recovering lead from a lead material including lead sulfide.

Referring now to FIG. 1, an example of the method for recovering lead from a lead material including lead sulfide is schematically depicted. In the examples disclosed herein, the lead material including lead sulfide PbSM may be an ore of lead or a concentrate of lead, either of which includes lead sulfide. The ore or concentrate may also include one or more of lead oxide, lead carbonate (i.e., cerussite or hydroxides thereof), and lead sulfate (i.e., anglesite). The concentrate of lead may be formed from an ore of lead. Prior to performing the recovery method(s) disclosed herein, the lead sulfide-containing material PbSM may be subjected to a particle size reduction process (i.e., comminution). It is generally desirable that the particle size of the lead sulfide-containing material PbSM range anywhere from 10 μm to about 500 μm. In an example, the reduced particle size may range anywhere from 50 μm to about 100 μm. Comminution may be accomplished by crushing, grinding, or another suitable size reduction process. The reduction in size may lead to increased reactivity of the lead sulfide-containing material PbSM and increased lead extraction efficiency.

At the outset of the method 10 shown in FIG. 1, methane sulfonic acid ($CH_3SO_3H$, also referred to herein as MSA) is selected as a leaching agent for the process. The selection of methane sulfonic acid is shown as "MSA" in FIG. 1. Methane sulfonic acid is a strong organic acid that is virtually free of metal ions and sulfates. It has been found that lead is highly soluble in methane sulfonic acid. For example, lead has a solubility of 143 g per 100 g of methane sulfonic acid in solution. As such, it is particularly desirable to select this acid for the lead recovery method(s) disclosed herein. In addition, the lead recovery method(s) 10 utilizing MSA surprisingly involved a speedy leach extraction (e.g., from about 10 minutes to about 120 minutes) and completeness of the reaction.

In the examples disclosed herein, the methane sulfonic acid is used in an aqueous solution including from about 0.01 wt. % MSA to about 30 wt. % MSA, an oxidant (e.g., oxygen ions or ferric ions), and a balance of water. In other examples, the aqueous solution may include from about 0.05 wt. % MSA to about 10 wt. % MSA, or from about 0.25 wt. % MSA to about 5 wt. % MSA. In one example, the methane sulfonic acid is LUTROPUR® MSA or LUTROPUR® MSA 100 (both of which are commercially available from BASF Corp., located in Florham Park, N.J.), the concentration of which is diluted by the addition of water. Examples of suitable oxidants include ferric methane sulfonate or oxygen (in the form of a gas or a soluble oxidant). In an example, at least two moles of ferric methane sulfonate are present per mole of PbS to be leached. In another example, at least 0.5 moles of oxygen (in gaseous form) is used per mole of PbS to be leached. The solution including methane sulfonic acid and the oxidant may be referred to herein as the MSA solution.

The MSA solution may be made by diluting a concentrated form of the MSA with a desirable amount of water and adding a suitable amount of the selected oxidant. The oxidant may be added by aerating the aqueous solution with air or oxygen gas. The oxidant may also be added by incorporating ferric methane sulfonate or a soluble oxidant, such as hydrogen peroxide. It is to be understood that the soluble form of ferric methane sulfonic acid may be obtained by dissolving iron from the lead raw material PbSM (containing an iron mineral impurity). For example, the ore may contain iron carbonate that dissolves in the MSA solution and is oxidized by the introduction of oxygen or air.

At reference numeral 12 in FIG. 1, the lead sulfide-containing material PbSM is exposed to the MSA solution. Exposure of the lead sulfide-containing material PbSM to the MSA solution involves contacting the solid lead sulfide-containing material PbSM with the liquid MSA solution. Solid-liquid contact may be accomplished by heap leaching, vat leaching, dump leaching, or by pulping the lead sulfide-containing material PbSM with the MSA solution. The lead sulfide-containing material PbSM is mixed with the MSA solution to produce a suspension. Exposure of the lead sulfide-containing material PbSM to the MSA solution initiates acid leaching of lead from the lead sulfide present in the lead sulfide-containing material PbSM, and generates a liquid leachate.

The amount of the lead sulfide-containing material PbSM and the amount of the MSA solution used may depend upon a target lead concentration for the liquid leachate formed during the step shown at reference numeral 12 of the method 10. In an example, the solid to liquid (i.e., PbSM to MSA solution) ratio is selected so that the resulting liquid leachate has a lead concentration that is sufficient for performing lead electrolysis. In an example, the target lead concentration in the liquid leachate ranges from about 5 g Pb/L leachate up to saturation. As an example, the target lead concentration in the liquid leachate is 50 g Pb/L leachate. The target lead concentration may vary depending, at least in part, upon the strength of the MSA solution to be used and the temperature to be used during leaching. In order to achieve the target lead concentration, the solid to liquid ratio is selected so that the suspension of PbSM in the MSA solution includes from about 1% solids to about 50% solids.

It is to be understood that the composition of the MSA solution may also be selected to match the target lead concentration. As an example, one molecule of MSA may be provided for each molecule of lead that is to be dissolved. It may also be desirable that excess MSA be present in order to maintain a minimum level of free acid in solution. As such, approximately 0.47 g of MSA may be used per gram of lead to be leached. In an example, if the lead sulfide-containing material PbSM includes about 50% lead and the target concentration is 500 g of lead per liter of leachate, then the amount of MSA in the MSA solution may be about 118 g MSA/L. The amount of MSA may be calculated using the following equation: 500 g Pb/L×50% (i.e., 50/100)×0.47 g MSA/g Pb=117.5 g MSA/L.

The suspension of the lead sulfide-containing material PbSM and MSA solution may be maintained at a predetermined temperature for a predetermined time as the liquid leachate is allowed to form. The predetermined temperature may range anywhere about 10° C. to about 100° C. or the boiling point of water. In an example, the predetermined temperature may range anywhere from about 10° C. to about 80° C. In another example, the predetermined temperature may range anywhere from about 20° C. to about 50° C. The temperature of the suspension may be increased to some temperature at the higher end of the given ranges in order to accelerate the rate and extent of the lead leaching. The time for maintaining the suspension may be any time that is sufficient to extract a desirable amount of the soluble lead from the lead sulfide-containing material PbSM. In an example, the time ranges from about 10 minutes to about 120 minutes.

While the liquid leachate is forming, the suspension may also be stirred. Stirring may be accomplished using any suitable mechanism including a baffle-stirred reactor, a magnetic stirrer, etc.

The liquid leachate that is formed includes water and a lead-methane sulfonate salt that is soluble in the water. The lead-methane sulfonate salt is the product of acid leaching of the lead sulfide originally present in the lead sulfide-containing material PbSM. When oxygen is used as the oxidant in the MSA solution, the following reaction may take place during the formation of the liquid leachate:

$$PbS+\tfrac{1}{2}O_2+2CH_3SO_3H \rightarrow Pb(CH_3SO_3)_2+H_2O+S.$$

A similar reaction may take place when other soluble oxidants, such as hydrogen peroxide, are utilized. When ferric methane sulfonate is used as the oxidant in the MSA solution, the following reactions may take place during the formation of the liquid leachate:

$$PbS+2Fe(CH_3SO_3)_3 \rightarrow Pb(CH_3SO_3)_2+2Fe(CH_3SO_3)_2+S$$

$$Pb+2Fe(CH_3SO_3)_3 \rightarrow Pb(CH_3SO_3)_2+Fe(CH_3SO_3)_2.$$

In any of the previous reactions, the lead-methane sulfonate salt ($Pb(CH_3SO_3)_2$) is generated in the liquid leachate. In the reaction involving the ferric methane sulfonate, ferrous methane sulfonate (i.e., $Fe(CH_3SO_3)_2$) is also generated, which is soluble in the liquid leachate.

In addition, if any lead carbonates or lead oxides are present, these components will also dissolve in the acid present in the liquid leachate. When lead oxides or lead carbonates are present, the following reactions may also take place during the formation of the liquid leachate:

$$PbO+2CH_3SO_3H \rightarrow Pb(CH_3SO_3)_2+H_2O$$

$$PbCO_3+2CH_3SO_3H \rightarrow Pb(CH_3SO_3)_2+H_2O+CO_2(g).$$

The first reaction involves the lead oxide (PbO) reacting with the methane sulfonic acid ($CH_3SO_3H$) to generate the lead-methane sulfonate salt ($Pb(CH_3SO_3)_2$) and water. The second reaction involves the lead carbonate ($PbCO_3$) reacting with the methane sulfonic acid ($CH_3SO_3H$) to generate the lead-methane sulfonate salt $Pb(CH_3SO_3)_2$, water, and carbon dioxide (in gas form).

In addition to at least the lead-methane sulfonate salt, the liquid leachate may also include a solid material, i.e., a leach solid or residue. As such, the liquid leachate may be exposed to a solid-liquid separation process (shown at reference numeral 14 of FIG. 1). Solid-liquid separation may be accomplished using thickening, filtration, centrifugation, cycloning, or another like technique in combination with washing. The solid-liquid separation results in the separation of the leach solid/residue from the liquid leachate. The use of the leach solid/residue will be discussed further hereinbelow in reference to reference numeral 22 of FIG. 1.

After solid-liquid separation, the liquid leachate may still contain impurities. As such, the step shown at reference numeral 16 of FIG. 1 involves purifying the liquid leachate. Reagent(s) $R_1$ may be added to the liquid leachate in order to remove impurities I. Examples of the reagent $R_1$ include pH adjusting agents or metallic lead powder or scrap.

In an example, purification of the liquid leachate is accomplished using pH adjustment, with or without aeration, to oxidize and hydrolyze impurities, such as iron, aluminum, chromium, etc. In this example, suitable pH adjusting agents include lead carbonate, sodium hydroxide, calcium oxide, calcium carbonate, magnesium oxide, magnesium carbonate, and sodium carbonate. The pH adjusting agent may be added in any amount that is sufficient to achieve a desirable pH value. For example, the pH adjusting agent may be added to the liquid leachate until the pH of the leachate is at the target value.

In another example, cementation may be used to purify the liquid leachate. During cementation, metallic lead powder or scrap is used to precipitate other noble metals, such as copper. The amount of metallic lead powder or scrap used will depend, at least in part, on the amount of impurities to be removed. In an example, the amount of metallic lead powder or scrap is proportional to the amount of impurities to be removed. As such, it may be desirable to use near stoichiometric amounts. Depending upon the metal impurity to be removed, it may also be desirable to include an excess of the metallic lead powder or scrap (i.e., an amount above the stoichiometric amount).

In still other examples, purification may also be accomplished with solvent extraction, ion exchange, or precipitation (e.g., sulfide precipitation) so as to remove the impurities I and produce a purified liquid leachate that is suitable for electrolysis.

Solvent extraction may be accomplished by mixing an organic solution containing the extractant with the aqueous liquid leachate. Mixing extracts the impurity into the organic phase. The solvent extraction reagents may vary depending upon the type of impurity to be removed. Some examples of suitable solvent extraction reagents include di-2-ethyl-hexyl-phosphoric acid and similar phosphonic or phosphinic acids, salicylaldoxime, mixtures including salicylaldoxime, VERSATIC™ acids (highly-branched carbon-rich molecules with vinyl ester, glycidyl ester, acrylate, hydroxyl and/or carboxylic functionality, from Momentive Specialty Chemicals, Gahanna, Ohio), etc. After the organic solution and the aqueous liquid leachate are mixed, the two solutions are separated, for example, by gravity settling. At this point, the organic solution is loaded with the impurity, and this solution may be exposed to stripping. The purified aqueous liquid leachate may then be used in electrolysis.

For liquid leachate purification via ion exchange, an ion exchange resin is contacted with the impure liquid leachate in a column or in a stirred reactor. Suitable ion exchange resins may include strong acid exchangers or chelating type exchangers. When precipitation is used to purify the liquid leachate, a chemical precipitant is added to the liquid leachate to precipitate the impurity as a solid particle. The solid particle impurities are removed using any suitable technique, such as filtering, thickening (e.g., gravity settling and washing), or the like. Examples of chemical precipitants that form sulfide precipitants include hydrogen sulfide gas, sodium hydrosulfide, calcium sulfide, sodium sulfide, etc.

While various examples have been given herein, it is to be understood that any suitable purification method may be used to selectively remove impurities I that are present in the liquid leachate, so long as the soluble lead-methane sulfonate salt remains in solution.

Figure 2:
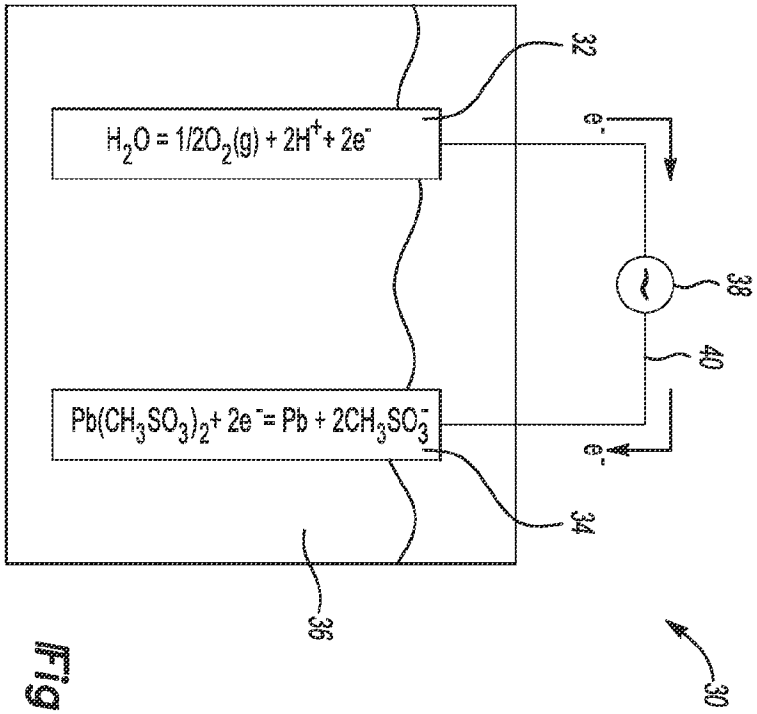
FIG. 2 is a schematic illustration of an undivided electrochemical cell for performing an electrolysis step of an example of the method for recovering lead from a lead material including lead sulfide.
Figure 3:
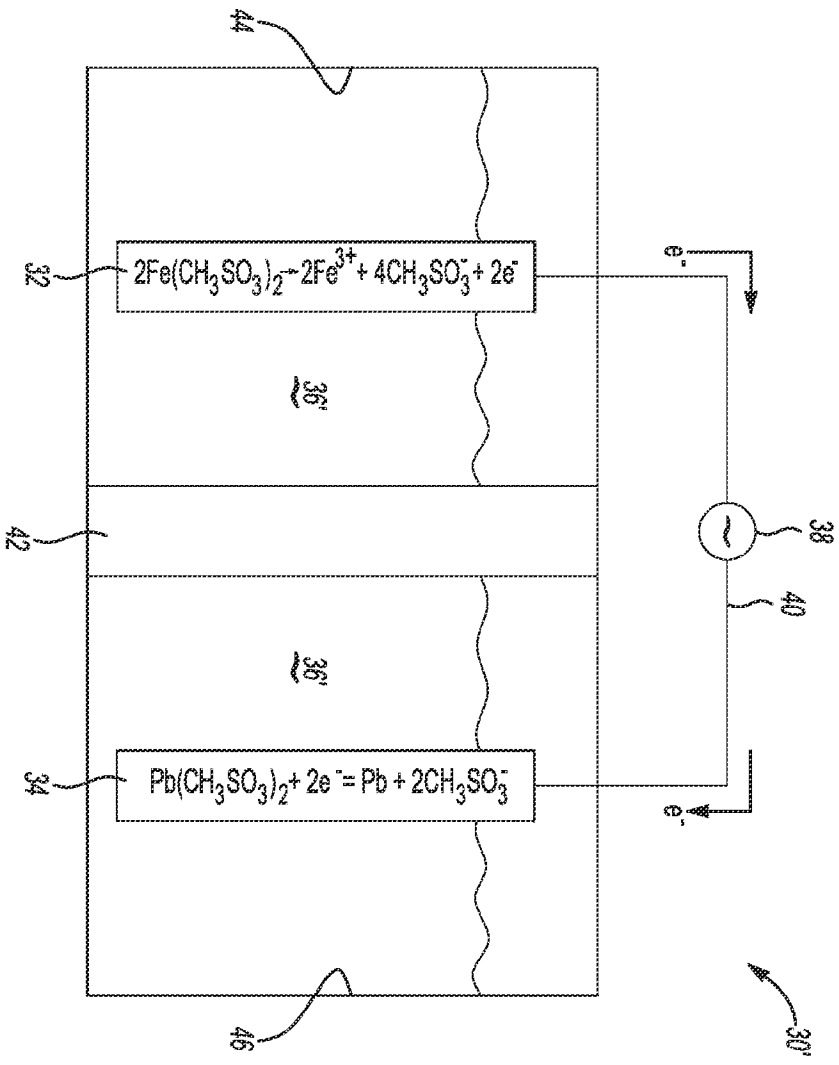
FIG. 3 is a schematic illustration of a divided electrochemical cell for performing an electrolysis step of another example of the method for recovering lead from a lead material including lead sulfide.

The purified liquid leachate is then exposed to electrolysis in order to recover lead. This is shown at the step 18 of FIG. 1. Electrolysis may be performed in an undivided electrochemical cell 30 (as shown in FIG. 2) or in a divided electrochemical cell 30' (as shown in FIG. 3). The electrochemical cell 30, 30' used will depend, at least in part, on the oxidant used in the MSA solution. When oxygen or hydrogen peroxide is utilized, the undivided electrochemical cell 30 may be used, and when ferric methane sulfonate is utilized, the divided electrochemical cell 30' may be used.

Referring now to FIG. 2, electrolysis may be accomplished in the undivided electrochemical cell 30 containing an anode 32 and a cathode 34. While a single anode 32 and cathode 34 are shown, it is to be understood that a single cell 30 may include multiple anodes 32 and cathodes 34. Examples of materials suitable for the anodes 32 include graphite, titanium structures coated with precious metal oxides (i.e., DSA anodes), or any other anode material. Examples of materials suitable for the cathodes 34 include lead, stainless steel, similar recyclable materials, or any other cathode material.

The purified liquid leachate (which in this example includes $Pb(CH_3SO_3)_2+H_2O$) is introduced into the cell 30 and functions as an electrolyte 36.

The electrodes 32, 34 may be connected to a power supply 38 via an external circuit 40. In operation, the power supply 38 and circuit 40 allow electric current and electrons ($e^-$) to flow between the electrodes 32, 34. In an example, current is supplied to the anode 32 at a current density ranging from about 100 $A/m^2$ to about 1000 $A/m^2$. The current density may be varied depending, at least in part, on the configuration of the cell 30.

When the cell 30 is operated, the power supply 38 delivers direct current (DC) to the anode 32, and electrowinning is initiated. In electrowinning, the current is passed from the anode 32 through the purified liquid leachate (i.e., the electrolyte 36) which contains the lead. It is to be understood that ionic current flows in solution. Cations are attracted to the cathode 34 and anions are attracted to the anode 32, and thus are conducted by the voltage gradient in solution between the electrodes 32, 34. The lead is extracted as it is deposited, in an electroplating process, onto the cathode 34. The overall chemical reaction in the cell 30 is:

$$Pb(CH_3SO_3)_2+H_2O \rightarrow Pb+2CH_3SO_3H+\tfrac{1}{2}O_2(g)$$

where the following reactions take place at the anode and cathode, respectively:

$$H_2O \rightarrow \tfrac{1}{2}O_2(g)+2H^++2e^-$$

$$Pb(CH_3SO_3)_2+2e^- \rightarrow Pb+2CH_3SO_3^-.$$

As illustrated in the chemical equations, lead is recovered as metal at the cathode 34 and oxygen is evolved at the anode 32 by electrolyzing the purified lead methane sulfonate solution (i.e., $Pb(CH_3SO_3)_2$).

Upon completion of electrolysis (and electrowinning), the electrolyte 36 (i.e., the purified liquid leachate) is depleted of lead and contains methane sulfonic acid. At this point (reference numeral 20 in FIG. 1) the lead-depleted, methane sulfonic acid-containing electrolyte 36 may be recycled and used in the MSA solution in another cycle of lead recovery. When the recycled MSA is used in another cycle of lead recovery, some amount of concentrated MSA may be added in order to generate a new MSA solution including from about 0.01 wt. % methane sulfonic acid to about 30 wt. % methane sulfonic acid.

Referring now to FIG. 3, electrolysis may be accomplished in the divided electrochemical cell 30' containing the anode 32 in an anode compartment 44 and the cathode 34 in a cathode compartment 46. The two compartments 44, 46 are separated by a diaphragm 42, such as a cloth diaphragm (e.g., a polypropylene filter cloth) or some other suitable separating material. The diaphragm 42 is generally permeable to the electrolyte 36' (which is the purified liquid leachate including $Pb(CH_3SO_3)_2+2Fe(CH_3SO_3)_2$), and enables diffusion of ions that are formed during electrolysis.

While a single anode 32 and cathode 34 are shown in FIG. 3, it is to be understood that the compartments 44, 46 of the cell 30' may include, respectively, multiple anodes 32 and cathodes 34. The electrode materials previously described are also suitable for this example.

The purified liquid leachate (which, as noted above, includes $Pb(CH_3SO_3)_2+2Fe(CH_3SO_3)_2$ in this example) is introduced into the respective compartments 44, 46 of the cell 30' and function as the electrolyte 36' in each of the compartments 44, 46.

In this example, the electrodes 32, 34 may be connected to the power supply 38 via the external circuit 40. In operation, the power supply 38 and circuit 40 allow electric current and electrons ($e^-$) to flow between the electrodes 32, 34. In an example, current is supplied to the anode 32 at a current density ranging from about 100 $A/m^2$ to about 1000 $A/m^2$. The current density may be varied depending, at least in part, on the configuration of the cell 30'.

When the cell 30' is operated, the power supply 38 delivers direct current (DC) to the anode 32, and electrowinning is initiated. In electrowinning, the current is passed from the anode 32 through the purified liquid leachates (i.e., the electrolyte 36') which contain the lead. As mentioned above, ionic current flows in solution. In the cathode compartment 46, the lead is extracted as it is deposited, in an electroplating process, onto the cathode 34. The overall chemical reaction in the cell 30' is:

$$Pb(CH_3SO_3)_2+2Fe(CH_3SO_3)_2 \rightarrow Pb+3Fe(CH_3SO_3)_3$$

where the following reactions take place at the anode 32 and cathode 34, respectively:

$$2Fe(CH_3SO_3)_2 \rightarrow 2Fe^{3+}+4CH_3SO_3^-+2e^-$$

$$Pb(CH_3SO_3)_2+2e^- \rightarrow Pb+2CH_3SO_3^-.$$

As illustrated in the chemical equations, lead is recovered as metal at the cathode 34 and the ferrous ion is oxidized to the ferric state at the anode 32 by electrolyzing the purified lead methane sulfonate solution (i.e., $Pb(CH_3SO_3)_2$).

Upon completion of electrolysis (and electrowinning), the electrolyte 36' (i.e., the purified liquid leachate) is depleted of lead and is rich in ferric methane sulfonate. At this point (reference numeral 20 in FIG. 1) the lead-depleted, ferric methane sulfonate-containing electrolyte 36' may be recycled and used in the MSA solution in another cycle of lead recovery.

In either of the examples shown in FIGS. 2 and 3, it is to be understood that electrolysis (and electrowinning) may be performed for any desirable amount of time in order to extract the lead from the electrolyte 36 or 36'. In an example, electroplating is allowed to take place for a period ranging from about 1 day to about 7 days. This may generate relatively thick deposits of pure lead on the cathode 34.

The temperature of the cell 30 or 30' during electrolysis may range from ambient temperature (e.g., 20° C.) to about 80° C. In an example, the temperature of the cell 30 or 30' is maintained from about 35° C. to about 45° C.

Electrochemical additives, such as animal glue, lignin sulfonates, aloes, etc. may be added to the cell 30 (of FIG. 2) or to the cathode compartment 46 of cell 30' (of FIG. 3) in order to smooth the cathode deposit and minimize contamination. In FIG. 3, the electrochemical additives may be added directly to the cathode compartment 46 or may be introduced via a feed that delivers the additives to the cathode compartment 46.

Referring back to the step shown at reference numeral 14 in FIG. 1, after the solid-liquid separation takes place, the method 10 may further include an additional step (at reference numeral 22) in which the separated leach solid/residue is utilized. In this example, the leach solid/residue includes sulfur and by-product metal (e.g., iron, gold, silver, etc.). The leach solid/residue may be treated with a reagent $R_2$ to generate a final solid FS and some by-product BP. For example, the leach solid-residue may be treated with the reagent $R_2$, such as NaCN, $Na_2S_2O_3$, or $(NH_4)_2S_2O_3$, under aeration conditions in order to extract final solids FS of iron, gold, silver, etc. These final solids FS may then be separated from any by-products.

While not shown in FIG. 1, the leach solid/residue may instead be exposed to other additional steps. These other additional steps may be particularly desirable when lead sulfate is present in the original lead sulfide-containing material PbSM or is formed as a result of sulfur oxidation during the leaching process. The lead sulfate is not leached during acid leaching (i.e., at the step shown at reference numeral 12 in FIG. 1), at least in part, because lead sulfate is essentially insoluble in the MSA solution. In the additional steps of the method 10 now being described, the lead sulfate may be converted to lead carbonate, which can be recycled in an MSA solution in another cycle of lead recovery.

In this example, the separated leach solid/residue that is recovered as a result of solid-liquid separation of the liquid leachate is treated with a source of soluble carbonate. Examples of the source of soluble carbonate include sodium carbonate, potassium carbonate, or ammonium carbonate. During this treatment, the leach solid/residue is pulped with an aqueous solution containing the soluble carbonate source. Pulping may be performed i) with a high solids density and a sufficient amount of the soluble carbonate, and ii) for a time and at a temperature so that lead sulfate phases/minerals in the leach solid/residue are converted to lead carbonate. In an example, the ratio of carbonate in solution to sulfate in the solids is at least 1:1 on a mole:mole basis. An example of the reaction that may take place when the leach solid/residue (which contains lead sulfate, $PbSO_4$) is treated with sodium carbonate as the source of soluble carbonate is as follows:

$$PbSO_4+Na_2CO_3 \rightarrow PbCO_3+Na_2SO_4.$$

The treatment of the leach solid/residue generates a second liquid leachate which includes a second leach solid/residue. The second liquid leachate is a sulfate solution containing a lead carbonate solid (i.e., the second leach solid/residue). The second liquid leachate may be exposed to a solid-liquid separation process, which may be performed using any of the techniques previously described. The solid-liquid separation results in the separation of the second leach solid/residue from the second liquid leachate.

The sulfate solution (i.e., the second liquid leachate) may be used in any desirable manner. In the example provided above, the sodium sulfate solution may be sold as a separate by-product or used in other processes (such as in the manufacture of detergents, or in the Kraft process of paper pulping, etc.).

At this point, the second leach solid/residue containing lead carbonate formed from lead sulfate may be recycled. For example, the second leach solid/residue may be incorporated into an MSA solution (with the lead sulfide-containing material PbSM) in another cycle of lead recovery. During the leaching process, the lead carbonate can react with the methane sulfonic acid to form the lead-methane sulfonate salt, from which the lead can be extracted and recovered.

To further illustrate the present disclosure, an example is given herein. It is to be understood that this example is provided for illustrative purposes and is not to be construed as limiting the scope of the present disclosure.

Example

Leaching of Lead Using Ferric Methane Sulfonate and MSA

A lead sulfide flotation concentrate containing 54.27% Pb, 15.29% Zn, 5.07% Fe, 0.20% Al, 0.14% C (inorganic) and 20.36% S (total) was obtained. X-Ray Diffraction with Rietveld Analysis was performed to identify the minerals in the concentrate. This analysis revealed that the concentrate included 0.9% hydrocerussite ($Pb_3(CO_3)_2(OH)_2$), 59.8% galena (PbS), 7.2% anglesite ($PbSO_4$), 21.2% sphalerite ((Zn, Fe)S), 6.8% pyrite ($FeS_2$), 1.3% marcasite ($FeS_2$), and 2.8% quartz ($SiO_2$).

The particle size of the concentrate was −75+48 microns (i.e., greater than 48 microns and smaller than 75 microns). A solution of ferric methane sulfonate and methane sulfonic acid was used. The solution had a methane sulfonic acid concentration of 0.5 mol/L and a ferric concentration (as $Fe^{3+}$) of 0.25 mol/L.

2 g of the concentrate was added to 500 mL of the solution in a 1 L baffled stirred reactor immersed in a water bath. The mixture was stirred at 500 rpm, and the temperature was set to 85° C. The mixture was allowed to react under these conditions. A liquid leachate was formed, and sample of the leachate were extracted over time. The extracted samples were analyzed for lead. The tests revealed that after 120 minutes of leaching, over 98% of the lead in the concentrate was extracted into solution.

It is to be understood that the ranges provided herein include the stated range and any value or sub-range within the stated range. For example, a range from about 10 μm to about 500 μm should be interpreted to include not only the explicitly recited limits of about 10 μm to about 500 μm, but also to include individual values, such as 15 μm, 120 μm, 250 μm, 400 μm, etc., and sub-ranges, such as from about 150 μm to about 450 μm, from about 200 μm to about 300 μm, etc. Furthermore, when "about" is utilized to describe a value, this is meant to encompass minor variations (up to +/−10%) from the stated value.

Reference throughout the specification to "one example", "another example", "an example", and so forth, means that a particular element (e.g., feature, structure, and/or characteristic) described in connection with the example is included in at least one example described herein, and may or may not be present in other examples. In addition, it is to be understood that the described elements for any example may be combined in any suitable manner in the various examples unless the context clearly dictates otherwise.

It is to be understood use of the words "a" and "an" and other singular referents may include plural as well, both in the specification and claims, unless the context clearly indicates otherwise.

While several examples have been described in detail, it will be apparent to those skilled in the art that the disclosed examples may be modified. Therefore, the foregoing description is to be considered non-limiting.

What is claimed is:

1. A method for recovering lead from a lead mineral material including a lead sulfide mineral, the method comprising:
- selecting methane sulfonic acid as a leaching acid for the lead mineral material;
- exposing the lead mineral material to a solution of the methane sulfonic acid and i) ferric methane sulfonate or ii) oxygen, thereby leaching lead from the lead sulfide mineral in the lead mineral material, and generating a liquid leachate including a lead-methane sulfonate salt;
- purifying the liquid leachate; and
- recovering lead from the purified liquid leachate using electrolysis.

2. The method as defined in claim 1 wherein the solution is an aqueous solution including from about 0.01 wt. % methane sulfonic acid to about 30 wt. % methane sulfonic acid.

3. The method as defined in claim 1 wherein prior to exposing the lead mineral material to the solution, the method further comprises:
- identifying a target lead concentration for the liquid leachate; and
- selecting a composition of the solution to match the target lead concentration.

4. The method as defined in claim 1 wherein exposing the lead mineral material to the solution further generates a leach solid including sulfur, and wherein the method further comprises:
- separating the leach solid from the liquid leachate; and
- reacting the leach solid with a reagent to generate a residue and a by-product.

5. The method as defined in claim 1, further comprising exposing the lead mineral material to a particle size reduction process prior to the exposing step, thereby generating particles of the mixed oxidized lead mineral material having a particle size ranging from about 10 μm to about 500 μm.

6. The method as defined in claim 1 wherein the exposing of the lead mineral material to the solution of includes:
- pulping the lead mineral material and the solution to form a mixture; and
- maintaining the mixture at a predetermined temperature for a predetermined time.

7. The method as defined in claim 6 wherein the predetermined temperature ranges from about 10° C. to about 80° C.

8. The method as defined in claim 1 wherein the exposing of the lead mineral material to the solution is accomplished by heap leaching, vat leaching, or dump leaching.

9. The method as defined in claim 1 wherein prior to the purifying step, the method further comprises performing a solid-liquid separation in order to separate solids from the liquid leachate.

10. The method as defined in claim 1 wherein the purifying step is accomplished by one of:
- pH adjustment in combination with aeration;
- cementation with metallic lead;
- solvent extraction;
- ion exchange; or
- sulfide precipitation.

11. The method as defined in claim 1 wherein:
- the solution includes methane sulfonic acid and ferric methane sulfonate;
- the liquid leachate includes the lead-methane sulfonate salt and ferrous methane sulfonate; and
- the electrolysis is accomplished by:
  - introducing the purified liquid leachate into first and second compartments of a divided electrochemical cell, wherein the first compartment includes an anode and the second compartment includes a cathode; and
  - passing a current from the anode through the purified liquid leachate in each of the first and second compartments so that i) lead in the purified liquid leachate is electroplated onto the cathode and ii) ferrous methane sulfonate in the purified liquid leachate is oxidized to generate ferric methane sulfonate at the anode.

12. The method as defined in claim 11, further comprising recycling the generated ferric methane sulfonate in a new solution of methane sulfonic acid and ferric methane sulfonate.

13. The method as defined in claim 11 wherein:
- a density of the current ranges from about 100 $A/m^2$ to about 1000 $A/m^2$; and
- a temperature of the electrolysis ranges from about 20° C. to about 80° C.

14. The method as defined in claim 11, further comprising adding an electrochemical additive
- i) to a feed that is delivered to the second compartment of the divided electrochemical cell, or
- ii) directly to the second compartment of the divided electrochemical cell.

15. The method as defined in claim 1 wherein:

the solution includes methane sulfonic acid and an oxidant;

the liquid leachate includes the lead-methane sulfonate salt and water; and the electrolysis is accomplished by:

introducing the purified liquid leachate into an undivided electrochemical cell including an anode and a cathode; and passing a current from the anode through the purified liquid leachate so that lead in the purified liquid leachate is electroplated onto the cathode.

16. The method as defined in claim 15, further comprising aerating the solution with oxygen or air to introduce the oxidant.

17. The method as defined in claim 15 wherein the oxidant is a soluble oxidant.

18. The method of claim 1 wherein the lead sulfide mineral is galena.

* * * * *